US005664487A

United States Patent [19]

Kaneko

[11] Patent Number: 5,664,487

[45] Date of Patent: Sep. 9, 1997

[54] SANITARY FILLING NOZZLE MOUNT

[75] Inventor: Yutaka Kaneko, Wheeling, Ill.

[73] Assignee: Tetra Laval Holdings & Finance SA, Buffalo Grove, Ill.

[21] Appl. No.: 715,080

[22] Filed: Sep. 19, 1996

[51] Int. Cl.[6] ..... A23C 9/00; A01J 25/00; A23G 9/00; A47J 31/40

[52] U.S. Cl. ..... 99/452; 99/275; 99/450.8; 99/494; 141/392; 141/295; 239/550; 239/553; 239/566; 239/600

[58] Field of Search ..... 99/275, 323.1, 99/323.3, 450.8, 452, 453, 460, 494; 141/295, 332, 387, 392; 239/550, 553, 566, 600, 81, 132.3, 390, 397, 698, 424.5, 549, 469, 587.1, 553.5, 590.3, 597

[56] References Cited

U.S. PATENT DOCUMENTS

| | | | |
|---|---|---|---|
| 2,672,187 | 3/1954 | Smith | 158/27.4 |
| 3,175,591 | 3/1965 | Manas et al. | 141/295 |
| 3,762,652 | 10/1973 | Huling | 239/469 |
| 4,050,633 | 9/1977 | Courson | 239/550 |
| 4,169,560 | 10/1979 | Vöhringer | 239/698 |
| 4,435,891 | 3/1984 | Nicholson | 230/566 |
| 4,567,926 | 2/1986 | Lichfield et al. | 141/392 X |
| 4,624,415 | 11/1986 | Hofstetter, Jr. | 239/553 X |
| 4,688,722 | 8/1987 | Dellassio et al. | 239/81 |
| 4,862,933 | 9/1989 | Gies | 99/452 X |
| 4,922,810 | 5/1990 | Siccardi | 99/275 X |
| 4,949,631 | 8/1990 | Fregnan | 9/452 |
| 4,951,879 | 8/1990 | Fay et al. | 239/566 X |
| 5,189,949 | 3/1993 | Apa | 99/323.3 |
| 5,423,245 | 6/1995 | Midden | 99/275 |
| 5,481,968 | 1/1996 | Clem | 99/452 |

*Primary Examiner*—Timothy F. Simone
*Attorney, Agent, or Firm*—Welsh & Katz, Ltd.

[57] ABSTRACT

A sanitary nozzle mount for use with a filling apparatus for flowing food product includes elongated, hollow, slidably engageable inner and outer filling tubes and a spacer coupling adapted to secure the inner and outer tubes in axially spaced relation with one another. The tubes are adapted to secure therebetween a removable filling nozzle having a mounting portion having a generally circular cross-section and including an inwardly extending, circumferential mounting ring. The inner and outer filling tubes each include a mounting element extending outwardly therefrom, configured for engagement with the spacer coupling. The inner filling tube has a length dimension greater than the length dimension of the outer filling tube. The inner tube includes a nozzle receiving end which has a circumferential locking element and a guide element which are adapted to engage the nozzle mounting ring therebetween. The coupling is positionable between the inner and outer filling tube mounting elements, and the nozzle mounting ring is positionable between the inner filling tube locking element and guide element to position the outer filling tube in overlapping engagement with the filling nozzle and to secure the nozzle between the filling tubes.

12 Claims, 3 Drawing Sheets

SANITARY FILLING NOZZLE MOUNT

FIELD OF THE INVENTION

This invention relates to a mounting system for filling nozzles. More particularly, the invention relates to a quick disconnect mounting system for filling nozzles for liquid food packaging systems.

BACKGROUND OF THE INVENTION

Liquid food packaging systems are well known in the art. Such systems are used, for example, for filling liquid food packages, such as milk cartons, juice boxes and the like.

Generally, a liquid food packaging system includes a liquid reservoir or tank for bulk storage of the liquid food, and liquid transfer means for transferring the bulk liquid to individual packages. In a typical arrangement, the liquid transfer means includes a series of metering pumps, liquid conduits and valves to supply the liquid food to a filling station. The filling station includes a delivery or filling nozzle. The filling nozzle introduces the liquid into the individual packages.

The nature of the food packaging industry requires that packaging systems are maintained at high levels of cleanliness. As such, it is important that the components of such systems are configured for relative ease of maintenance and periodic cleaning. It is thus desirable to have the food contacting or food bearing components readily disassemblable and the food contacting surfaces accessible for cleaning and maintenance.

It is also important to maintain close tolerances between the surfaces of components. Close tolerances prevent liquid food product from entering spaces not designed for food product carriage. In addition, the close tolerances prevent contamination of the food product from contaminants which may exist on the non-food bearing components and surfaces.

In one known system, the filling nozzle is formed of a soft, flexible, polymeric material, such as a medical or food grade, silicone based polymer. The nozzle has a mounting portion and a nozzle portion. The mounting portion has a circular cross-section. The nozzle portion includes a plurality of axial and angled, generally axially extending creases which define a plurality of gore-like panels in the nozzle. When in the closed position, the gore-like panels form a generally cruciform-shaped configuration. In the open position, the nozzle portion has a square cross-section which is adapted to fit into the top of a square cross-sectional shaped container, such as a milk carton.

The nozzle is secured to the filling apparatus by inner and outer filling tubes which are enclosed within a cleaning box. The tubes are slidably engageable relative to one another. The inner filling tube includes a flared portion having a circumferential channel formed therein at the end of the filling tube to which the nozzle is mounted. The nozzle includes an inwardly extending, circumferentially oriented locking lip which is adapted to fit into the channel. With the locking lip in place in the channel, the outer tube is slid or urged upward, over the nozzle, to secure the nozzle between the filling tubes.

There are a number of drawbacks to this type of arrangement. First, the mounting arrangement of the filling tubes within the cleaning box requires that both the outer and inner filling tubes be removed from the filling apparatus to remove the nozzle. Disassembly of the apparatus adds expense in that significant time and effort are required to disassemble the apparatus and remove the nozzle. Given that the nozzles are removed for cleaning and replacement on a prescribed schedule or as maintenance requires, the increased time required to remove the nozzle can result in considerable expense and down time of the filling apparatus.

Another drawback is that the known mount configuration provides less than optimal means to retain the inner and outer filling tubes concentric relative to each other. Due to the nature of the filling nozzle material and the relative flexibility thereof, the nozzle shape may become irregular due to forces that are exerted on the nozzle by the filling tubes. In particular, eccentricity of the inner and outer filling tubes may cause the nozzle shape to become irregular which in turn may result in less than complete closure of the nozzle. Therefore, it is highly desirable to retain the inner and outer nozzles concentric relative to each other.

Last, the known mounting configuration, while adequate to retain a filling nozzle in place in the filling apparatus, does not augment the quick-close function of the nozzle. The nozzles are designed and configured to close quickly upon termination of the flow of food product. Closure of the nozzle is desired to prevent spillage or wastage of the food product.

The known mounting configuration inhibits rather than fosters this quick-close feature of the nozzle. Forces which are exerted on the nozzle by the mating of the inner and outer filling tubes create a moment which urges the nozzle into the open position. Thus, the tubes exert forces on the nozzle which act against the natural tendency of the nozzle to close.

Accordingly, there continues to be a need for a sanitary filling nozzle mount which has a quick connect-disconnect configuration that minimizes the time and effort required to remove and install the filling nozzle.

Such a mount should retain the inner and outer filling tubes concentric with one another to retain the nozzle in its predetermined shape or profile. Preferably, such a mount enhances the quick closure feature of the filling nozzle by exerting a force on the nozzle which creates a moment that urges the nozzle to the closed position.

SUMMARY OF THE INVENTION

A sanitary nozzle mount for use with a filling apparatus for flowing food product includes inner and outer elongated, hollow, slidably engageable filling tubes and a spacer coupling adapted to secure the inner and outer tubes in axially spaced relation with one another. The mount is configured for use with a filling apparatus which uses a removable filling nozzle having a mounting portion and a nozzle portion. The mounting portion has a generally circular cross-section and includes an inwardly extending, circumferential mounting ring. The nozzle portion has a plurality of gore-like panels therein which are defined by a plurality of axial and angled, generally axial creases.

The mount permits removal and replacement of the filling nozzle by sliding engagement and disengagement of the tubes, without removing the tubes from the filling apparatus.

The outer filling tube has a predetermined length dimension, and includes a mounting element extending outwardly therefrom which is adapted for engagement with the spacer coupling. The outer tube is configured to be mounted to the apparatus. The outer tube may remain in place, mounted to the apparatus, during removal and replacement of filling nozzles.

The inner filling tube has a length dimension which is greater than the length dimension of the outer filling tube. The inner tube has a nozzle receiving end which includes a circumferential locking element extending outwardly therefrom which is adapted to engage the nozzle mounting ring.

The inner filling tube is concentrically positioned within the outer filling tube for sliding engagement therewith. The inner tube has a guide element extending outwardly therefrom which is adapted to engage the outer filling tube to maintain concentricity between the filling tubes.

The spacer coupling is adapted to fit between and engage the inner and outer filling tubes at their respective mounting elements. The coupling is configured so that when it is positioned between the filling tube mounting elements, and when the nozzle is mounted to the inner tube, with the mounting ring positioned between the locking element and the guide element, the outer filling tube is positioned in overlapping engagement with the filling nozzle and secures the nozzle between the filling tubes.

In a preferred embodiment, the inner and outer filling tube mounting elements are continuous, circumferentially extending rings which extend about their respective filling tubes.

In a most preferred embodiment, the mounting elements include angled surfaces, and the spacer coupling includes complementary angled surfaces. The angled surfaces coact to provide interlocking relationships between the filling tubes and the space coupling.

Other features and advantages of the present invention will be apparent from the following detailed description, the accompanying drawings, and the appended claims.

DETAILED DESCRIPTION OF THE PREFERRED EMBODIMENTS

Figure 1:
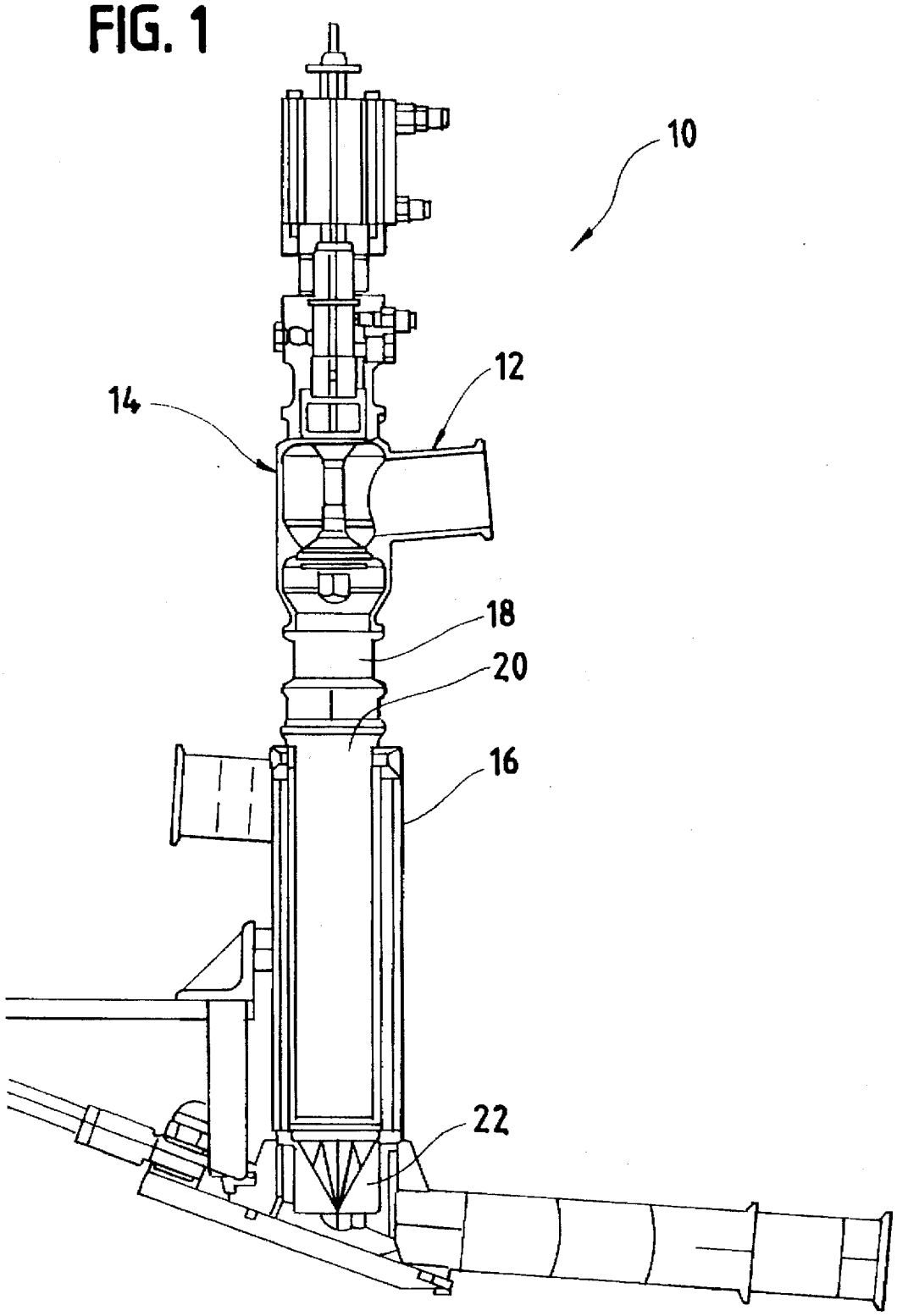
FIG. 1 illustrates a portion of an exemplary food product filling apparatus, the apparatus being shown with a mounting system embodying the principles of the present invention.

While the present invention is susceptible of embodiment in various forms, there is shown in the drawings and will-hereinafter be described a presently preferred embodiment with the understanding that the present disclosure is to be considered an exemplification of the invention and is not intended to limit the invention to the specific embodiment illustrated.

With reference now to the figures, and particularly to FIG. 1, there is shown a portion of a liquid food product filling apparatus 10. The apparatus 10 may be used for, for example, filling individual packages, e.g., quart containers, of milk, juice and the like. The packages may take the form of readily recognized gable top milk containers.

The apparatus 10 includes generally a bulk food reservoir or tank (not shown) and a series of liquid conduits 12 and valves 14 for transferring a predetermined quantity of the liquid food to each package. The conduits 12 and valves 14 may be configured to direct the liquid food to more than one package at a time. In one embodiment, the filling apparatus 10 includes eight sets of liquid conduits 12 and valves 14 to simultaneously fill eight liquid packages.

The apparatus 10 may include a control system for controlling the amount of liquid food introduced into each package. The operation, design and application of such a control system will be readily recognized by those skilled in the art. Such a control system may also control the movement of the packages through the filling apparatus 10, as well as the sealing and packaging thereof.

The terminal end of the filling apparatus 10 includes a cleaning box 16 which encloses inner and outer, slidably engageable filling tubes 18, 20. The tubes 18, 20 are configured to provide a liquid pathway to deliver the liquid food product to the packages through a filling nozzle 22.

Figure 5A:
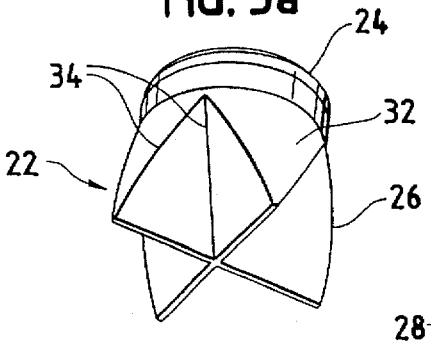
FIG. 5*a* is a perspective view of an exemplary filling nozzle.
Figure 5B:
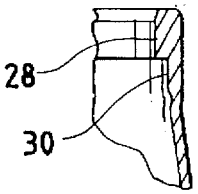
FIG. 5*b* is a partial cross-sectional view of the filling nozzle wall illustrating the nozzle mounting ring.
Figure 6:
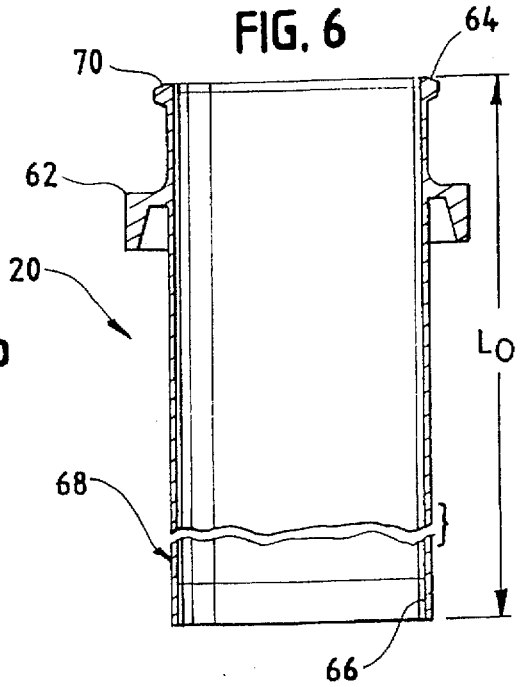
FIG. 6 is a cross-sectional view of the outer filling tube.
Figure 7:
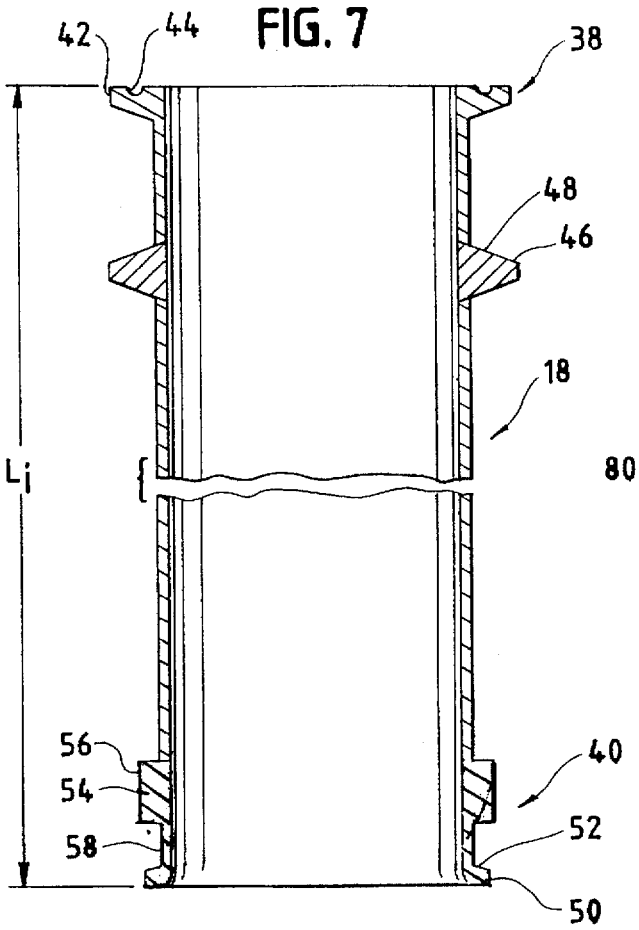
FIG. 7 is a cross-sectional view of the inner filling tube.

The nozzle 22, which is best seen in FIGS. 5*a* and 5*b*, is configured to permit the flow of liquid when in the open position and to terminate the liquid flow when in the closed position. The nozzle 22 has a valve-like configuration and includes a mounting portion 24 and a nozzle portion 26.

The mounting portion 24 of the nozzle 22 has a circular cross-section and includes a circumferential mounting ring 28 extending inwardly therefrom. The mounting ring 28 is adapted to coact with and secure the nozzle 22 to the inner and outer filling tubes 18.20. The mounting ring 28 may include an angled surface, as illustrated at 30, to facilitate axially positioning the nozzle 22 relative to the filling tubes 18, 20.

The nozzle portion 26 includes a plurality of gore-like panels 32 which fold inward to terminate flow through the nozzle 22. The gore-like panels 32 are defined by a plurality of axial and angled, generally axial creases 34 in the nozzle 22 wall. When in the fully open position, the nozzle portion 26 has a generally square cross-section which is configured to fit within the container being filled. When in the closed position, the nozzle portion 26 has a generally cruciform-like configuration.

The nozzle 22 is formed of a flexible, food-grade or medical-grade, polymeric material, such as a silicone based polymer. The nozzle 22 is formed having wall thicknesses which readily permit the nozzle 22 to flex between the opened and closed positions. The nozzle 22 is designed to tend toward the closed position when "relaxed" and unstressed.

Referring now to FIGS. 2–4 and 6–7, the filling tubes 18, 20 are adapted to slidingly engage one another and to secure the nozzle 22 therebetween. The inner filling tube 18 includes an apparatus mounting end 38 and a nozzle receiving end 40. The apparatus mounting end 38 includes a flange 42 extending therefrom. In a preferred embodiment, the flange 42 is a continuous, circumferential ring extending about the apparatus mounting end 38 of the inner filling tube 18. The flange 42 may include a groove or channel 44 formed therein. The channel 44 is adapted to receive an O-ring or like sealing member. The flange 42 is mounted to the filling apparatus 10 and clamped thereto by a dairy clamp (not shown).

The inner tube 18 includes an outwardly extending mounting element 46 intermediate the apparatus mounting end 38 and the nozzle receiving end 40. The mounting element 46 is configured to permit clamping the inner and outer tubes 18, 20 to one another in proper axial alignment. The mounting element 46 may include angled surfaces thereon, as illustrated at 48, to further facilitate mounting and proper axial alignment of the filling tubes 18, 20 to each other.

The nozzle receiving end 40 of the inner filling tube 18 includes a circumferential locking element 50 extending outwardly therefrom. Preferably, the locking element 50 is a continuous circumferential ring extending about the outer surface of the inner filling tube 18. The locking ring 50 is adapted to engage the nozzle mounting ring 28 when the nozzle 22 is slid over the receiving end 40 of the filling tube 18. The locking ring 50 may include an angled surface, illustrated at 52 which is configured to be complementary with the angled surface 30 of the nozzle mounting ring 28. The complementary, angled mating surfaces 30, 52 enhance engagement therebetween and provide additional assurance of axial alignment between the nozzle 22 and the filling tubes 18, 20.

To maintain the inner and outer filling tubes 18, 20 concentric relative to each other, the inner filling tube 18 includes a guide element 54. The guide element 54 extends outwardly from the outer surface of the filling tube 18. In a current embodiment, the guide element 54 is formed as a continuous circumferential ring which extends about the outer surface of the filling tube 18. The guide element 54 may include an angled surface, as illustrated at 56, to facilitate the sliding engagement of the filling tubes 18, 20 relative to one another.

In the illustrated embodiment, the guide element 54 facilitates proper axial positioning of the nozzle 22 by defining a channel 58 between the guide element 54 and the locking ring 50. The channel 58 is configured to receive the nozzle mounting ring 28 when the nozzle 22 is positioned on the inner filling tube 18.

The outer filling tube 20 is slidably engageable with the inner filling tube 18. The outer tube 20 has a length dimension $L_o$ which is less than a length dimension $L_i$ of the inner tube 18. This configuration permits the inner tube 18 to slide within the outer tube 20, with either or both the mounting and nozzle receiving ends 38, 40 of the inner tube 18 exposed.

The outer tube 20 includes a mounting flange 62 which is configured to permit mounting the outer tube 20 to the filling apparatus 10 at the cleaning box 16. The outer tube 20 also includes a mounting element 64 which is adapted for mounting the outer tube 20 to the inner filling tube 18. In a preferred embodiment, the mounting element 64 is a continuous, circumferential ring which extends about an outer surface of the outer tube 20.

The mounting element 64 may have angled surfaces, as illustrated at 70, to facilitate mounting and axial alignment of the filling tubes 18, 20, relative to one another. The outer filling tube may include a tapered inner surface, as illustrated at 66, to facilitate and ease engaging the filling tubes 18, 20 with each other, with the nozzle 22 positioned therebetween.

Figure 3:
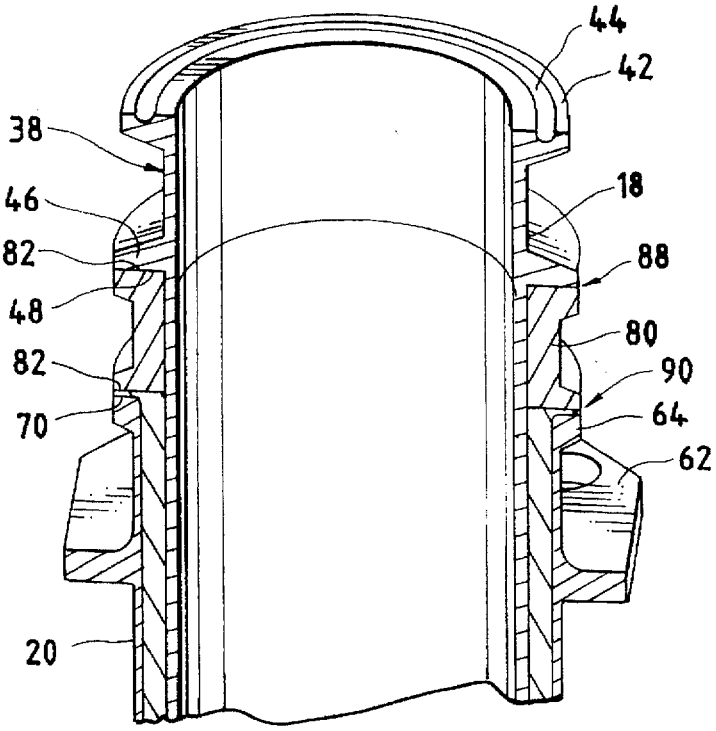
FIG. 3 is a partial cross-sectional view of the apparatus mounting end of the mounting system.
Figure 8:
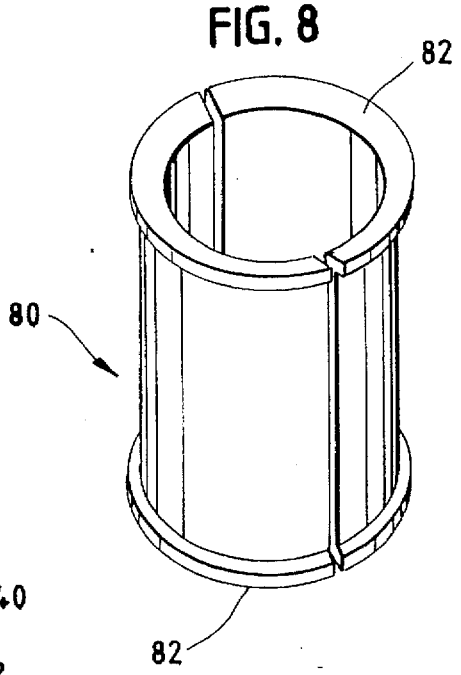
FIG. 8 is a perspective view of the spacer coupling.

Referring to FIGS. 3 and 8, a removable spacer coupling 80 is adapted to fit between and engage both the outer tube mounting element 64 and the inner tube mounting element 46. The coupling 80 secures the mounting elements 46, 64, and thus the filling tubes 18, 20, in a fixed axial position relative to one another. The spacer coupling 80 includes angled surfaces, as illustrated at 82, which are complementary with the angled surfaces 48, 70 in the tube mounting elements 46, 64. This arrangement permits an interlocking relationship between the spacer coupling 80 and the mounting elements 46, 64 when the nozzle mount is assembled. In a preferred embodiment, as best seen in FIG. 8, the spacer coupling 80 has an axially spilt configuration to facilitate positioning the coupling 80 between the filling tubes 18, 20.

Referring now to FIG. 3 which illustrates the apparatus mounting end 38 of the assembled nozzle mount, clamps (not shown), such as dairy clamps are positioned over each the spacer coupling and the inner tube mounting element juncture, as illustrated at 88, and the spacer coupling and outer tube mounting element juncture as illustrated at 90. The dairy clamps secure the nozzle mount components together to provide a leak-tight assembly. The angled mating surfaces of the filling tubes 18, 20 and spacer coupling 80, when compressed by the dairy clamps, are subjected to both axial and radial compressive force components which enhance the seal between the filling tubes 18, 20 and the coupling 80.

Figure 2:
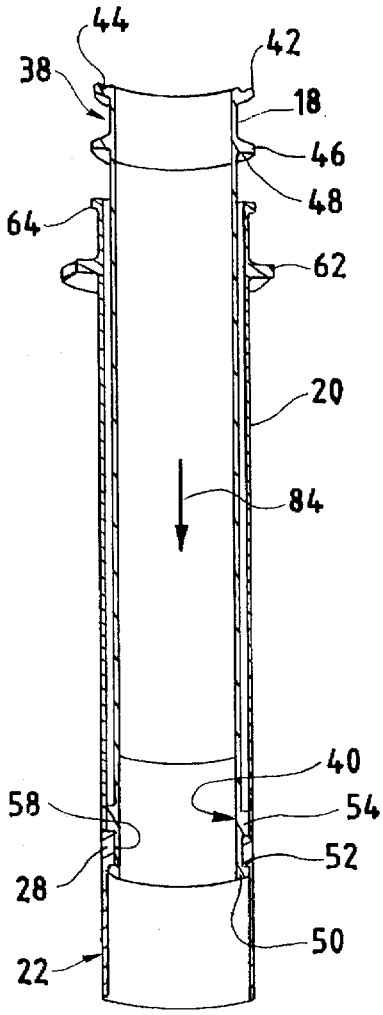
FIG. 2 is a cross-sectional view of the mounting system of the present invention, shown with a nozzle mounted thereto, and illustrated without the spacer coupling for clarity of illustration.

In the assembled configuration, as shown in FIG. 2, the nozzle 22 is mounted to the inner filling tube 18 with the nozzle mounting ring 28 positioned between the inner tube locking ring 50 and the guide element 54. The outer tube 20 is positioned with a portion thereof overlapping the nozzle 22 at about the mounting ring 28. The overlapping arrangement secures the nozzle 22 in place, between the filling tubes 18, 20.

Referring to FIG. 3, the coupling 80 is positioned around the inner filling tube 18, between the inner and outer tube mounting rings 46, 64. The coupling 80 spaces the mounting rings 46, 64, and thus the filling tubes 18, 20 in a fixed position relative to each other. This arrangement retains the outer tube 20 positioned over the inner tube 18, and maintains the outer tube 20 overlapping a portion of the nozzle 22. The dairy clamps are positioned over the coupling 80 at the respective inner and outer tube mounting elements 46, 64.

In use, the present mounting system facilitates removal of the nozzle 22 from the filling apparatus 10, without removing the inner and outer filling tubes 18, 20 from the cleaning box 16. To remove the nozzle 22, the dairy clamp which secures the inner filling tube 18 to the apparatus 10, and the clamps which secure the coupling 80 in place are removed. The coupling 80 is then removed from between the inner and outer tubes 18, 20.

Figure 4:
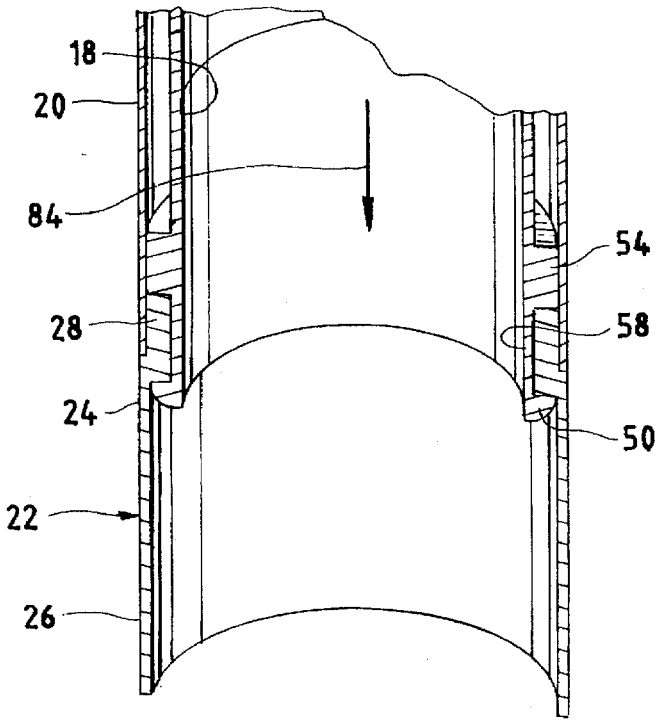
FIG. 4 is a partial cross-sectional view of the nozzle mounting end of the system.

With the coupling 80 removed, the inner tube 18 is urged downward, away from the filling apparatus 10, as illustrated by the arrow at 84 in FIG. 4. The inner filling tube 18 is sufficiently longer than the outer tube 20 to permit the inner tube 18 to be urged downward to disengage the outer tube 20 from overlapping engagement with the nozzle 22, without removing the outer tube 20 from the cleaning box 16. The flexible nozzle 22 can then be removed from the inner filling tube 18, without interference from the outer tube 20.

To replace the nozzle 22, the opposite procedure is followed. With the coupling 80 removed and the inner tube 18 moved downward, a nozzle 22 is positioned on the inner filling tube 18 at the receiving end 40. The nozzle 22 is positioned so that the nozzle mounting ring 28 is disposed between the guide element 54 and the locking ring 50.

With the nozzle 22 in place, the inner tube 18 is urged upward, toward the filling apparatus 10. When the mounting flange 42 abuts the apparatus 10, the inner tube 18 is properly positioned. This arrangement positions the outer tube 20 in overlapping engagement with the nozzle 22. The coupling 80 is then placed between the inner and outer tube mounting elements 46, 64 to secure the position of the tubes 18, 20 relative to each other. The dairy clamps are then repositioned on the assembly.

Advantageously, as the inner tube 18 is urged upward, which positions the outer tube 20 in overlapping engagement with the nozzle 22, the force exerted by the mating tubes 18, 20 creates an inward moment on the nozzle. The inward moment urges the nozzle into the closed position. Thus, the present mounting system enhances the natural closure action of the nozzle 22 through application of an inward moment.

In addition, the close fit between the guide element 54 and the outer filling tube 20 provides an additional barrier to prevent inleakage of liquid food product into the space between the inner and outer tubes 18, 20. The guide element 54 also maintains the inner and outer filling tubes 18, 20 concentric relative to each other which in turn maintains the desired cross-sectional shape of the nozzle 22.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A sanitary nozzle mount for use with a filling apparatus for flowing food product, the filling apparatus having a removable filling nozzle having a mounting portion and a nozzle portion, the nozzle portion having a generally circular cross-section and including an inwardly extending, circumferential mounting ring, the nozzle portion having a plurality of gore-like panels therein defined by a plurality of axial and angled, generally axial creases, the mount comprising:

an elongated, hollow, cylindrical outer filling tube, the outer filling tube having a length dimension, and including a mounting element extending outwardly therefrom;

an elongated, hollow, cylindrical inner filling tube, said inner filling tube having a length dimension greater than the length dimension of said outer filling tube, said inner filling tube having a nozzle receiving end having a circumferential locking element extending outwardly therefrom adapted to engage said nozzle mounting ring, said inner filling tube being concentrically positioned relative to said outer filling tube for sliding engagement therewith, said inner filling tube having a guide element extending outwardly therefrom adapted to engage said outer filling tube, said guide element being configured to maintain concentricity between said inner and outer filling tubes; and a removable spacer coupling adapted to fit between and engage said inner filling tube mounting element and said outer filling tube mounting element, wherein when said coupling is positioned between said inner and outer filling tube mounting elements, and when said nozzle mounting ring is positioned intermediate said locking element and said guide element, said outer filling tube is positioned in overlapping engagement with said filling nozzle at about said mounting ring, to secure said nozzle between said inner and outer filling tubes.

2. The sanitary nozzle mount in accordance with claim 1, wherein said inner filling tube mounting element extends circumferentially about said inner filling tube.

3. The sanitary nozzle mount in accordance with claim 2 wherein said inner filling tube mounting element is continuous.

4. The sanitary nozzle mount in accordance with claim 1 wherein said inner filling tube mounting element includes an angled surface, and wherein said spacer coupling includes an angled surface which is complementary with said mounting element angled surface.

5. The sanitary nozzle mount in accordance with claim 1 wherein said outer filling tube mounting element extends circumferentially about said outer filling tube.

6. The sanitary nozzle mount in accordance with claim 5 wherein said outer filling tube mounting element is continuous.

7. The sanitary nozzle mount in accordance with claim 1 wherein said outer filling tube mounting element includes an angled surface, and wherein said spacer coupling includes an angled surface which is complementary with said mounting element angled surface.

8. A sanitary nozzle mount for use with a filling apparatus for liquid food product, the filling apparatus having at least one filling nozzle having a mounting portion having an inwardly extending, circumferential mounting ring, and a nozzle portion, the mount comprising:

inner and outer slidingly engageable, elongated, cylindrical filling tubes, said filling tubes being engageable with one another to secure the nozzle therebetween at respective nozzle receiving ends, said outer filling tube having a mounting element extending outwardly therefrom, said inner filling tube having a circumferential locking element extending outwardly from said nozzle receiving end adapted to engage said nozzle mounting ring, said inner filling tube having a guide element extending outwardly therefrom adapted to coact with said outer filling tube, said inner filling tube including a mounting element extending outwardly therefrom; and a removable spacer coupling adapted to fit between said inner filling tube mounting element and said outer filling tube mounting element to maintain said mounting elements in axially spaced relation to one another, wherein said nozzle mounting ring is positionable intermediate said locking element and said guide element, and said outer filling tube is positionable in overlapping engagement with said nozzle to secure said nozzle between said inner and outer filling tubes, and wherein said spacer coupling is mountable between said filling tube mounting elements to position said outer tube in overlapping engagement with said nozzle to secure said nozzle between said inner and outer filling tubes.

9. The sanitary nozzle mount in accordance with claim 8 wherein said guide element is configured to maintain said inner filling tube concentric with said outer filling tube.

10. The sanitary nozzle mount in accordance with claim 8 wherein said guide element is a circumferential, continuous ring extending about said inner filling tube.

11. The sanitary nozzle mount in accordance with claim 8 wherein said outer filling tube mounting element includes an angled surface, and wherein said spacer coupling includes an angled surface which is complementary with said mounting element angled surface.

12. The sanitary nozzle mount in accordance with claim 8 wherein said inner filling tube mounting element includes an angled surface, and wherein said spacer coupling includes an angled surface which is complementary with said mounting element angled surface.

* * * * *